US005106212A

United States Patent [19]

Endo et al.

[11] Patent Number: 5,106,212

[45] Date of Patent: Apr. 21, 1992

[54] PRINTING HEAD SUPPORTING DEVICE

[75] Inventors: Kouzi Endo; Seiji Koike; Takeshi Tashiro; Kazuhiko Hiramatsu; Kazuhiro Fushimi; Tsugio Shiozaki, all of Shizuoka, Japan

[73] Assignee: Tokyo Electric Co., Ltd., Tokyo, Japan

[21] Appl. No.: 677,341

[22] Filed: Mar. 29, 1991

[30] Foreign Application Priority Data

Mar. 30, 1990 [JP] Japan ..... 2-86241
Dec. 14, 1990 [JP] Japan ..... 2-403320[U]

[51] Int. Cl.[5] ..... B41J 3/02

[52] U.S. Cl. ..... 400/120; 400/56; 346/76 PH

[58] Field of Search ..... 400/120, 56; 346/76 PH

[56] References Cited

U.S. PATENT DOCUMENTS 4,235,555 11/1980 Aprato ..... 400/120

FOREIGN PATENT DOCUMENTS 3616925 4/1987 Fed. Rep. of Germany ..... 400/120
0001776 1/1982 Japan ..... 400/120
0155485 8/1985 Japan ..... 400/120
0132362 6/1986 Japan ..... 400/120
0286767 12/1987 Japan ..... 400/120
0095958 4/1988 Japan ..... 400/120

*Primary Examiner*—Eugene H. Eickholt
*Attorney, Agent, or Firm*—Oblon, Spivak, McClelland, Maier & Neustadt

[57] ABSTRACT

A printing head supporting device including a supporting mechanism for supporting a printing head so that the printing head can be brought into contact with and separation from a platen, and a pressure plate detachably mounted to a printer body. When the pressure plate is mounted to the printer body, the printing head is maintained in contact with the platen to obtain a printable condition. In contrast, when the pressure plate is detached from the printer body, the printing head is maintained in separation from the platen, so that an operator can easily carry out a maintenance work such as cleaning of the printing head or removing of a recording paper caught between the printing head and the platen. Thus, the maintenance work can be easily carried out by a simple operation such that the pressure plate is simply detached from the printer body.

11 Claims, 3 Drawing Sheets

PRINTING HEAD SUPPORTING DEVICE

FIELD OF THE INVENTION AND RELATED ART STATEMENT

The present invention relates to a printing head supporting device for supporting a printing head and deciding a relative position between the printing head and a platen, and more particularly to a printing head supporting device having a structure such that the printing head is so supported as to be brought into contact with and separation from the platen.

Conventionally, there exists a line printer including a line printing head adapted to be pressed against a platen for printing a bar code or the like on a recording medium extending along the platen. Such a line printer is provided with a printing head supporting device for supporting the printing head and deciding a relative position between the printing head and the platen. For example, such a printing head supporting device has a structure such that the printing head is fixed to a frame or the like of a printer body so as to contact the platen, or a structure such that the printing head is so supported as to be brought into contact with and separation from the platen, and is biased toward the platen.

Such a prior art device as mentioned above has the following defects. In general, a thermal head is used as the printing head in the line printer, and a stain or the like due to dust or a thermal paper is deposited onto a surface of the thermal head as time proceeds, causing a deterioration in printing quality. In the case where the deposition of the stain on the thermal head is remarkable, there is a possibility that the bar code printed cannot be read by a bar code scanner or the like. Accordingly, it is necessary to periodically clean the printing head, and at this time, the printing head must be separated from the platen. Further, in the event that the recording medium is caught between the platen and the printing head, it is necessary to remove the recording medium caught. Also in such a case, the printing head must be separated from the platen.

However, in the printing head supporting device of the structure that the printing head is fixed to the frame of the printer body, the printing head must be removed from the frame by using a tool such as a screwdriver, so as to bring the printing head into separation from the platen. Accordingly, the work becomes troublesome, and much working time is required.

On the other hand, in the printing head supporting device of the structure that the printing head is so supported as to be brought into contact with and separation from the platen, the separation of the printing head from the platen can be easily effected in itself. However, the structure for biasing the printing head toward the platen is complicated. Furthermore, a permissible range of a proper contact pressure of the printing head to be applied to the platen is narrow, and a permissible range of an error of a contact position of the printing head with respect to the platen is also narrow. Since a printing quality is delicately influenced by the contact pressure and the contact position of the printing head with respect to the platen, the biasing structure is hard to design and manufacture.

OBJECT AND SUMMARY OF THE INVENTION

It is a first object of the present invention to provide a printing head supporting device which can make a maintenance work easy.

It is a second object of the present invention to provide a printing head supporting device which has a simple structure.

It is a third object of the present invention to provide a printing head supporting device which can maintain a constant printing quality.

It is a fourth object of the present invention to provide a printing head supporting device which can be easily designed.

It is a fifth object of the present invention to provide a printing head supporting device which can be easily manufactured.

The printing head supporting device according to the present invention achieving the above objects is provided with a supporting mechanism for supporting a printing head so that the printing head can be brought into contact with and separation from a platen, and is further provided with a pressure plate detachably mounted to a printer body, wherein when the pressure plate is mounted to the printer body, the printing head is brought into contact with the platen by the pressure plate, while when the pressure plate is detached from the printer body, the printing head is allowed to separate from the platen by the pressure plate. With this construction, the printing head can be easily brought into separation from the platen by the rotation of the printing head upon detaching the pressure plate from the printer body. Accordingly, no complicated work is required in carrying out a maintenance work such as cleaning of the printing head or removing of a recording medium caught between the printing head and the platen, thereby making the maintenance work easy and accordingly reducing a working time required for the maintenance work. Further, the structure is simple, and the designing and manufacturing are easy. Particularly, in comparison with the conventional structure such that the printing head is biased to contact the platen by means of a coil spring or the like, a contact pressure of the printing head to be applied to the platen can be easily set.

The printing head supporting device may further include a maintenance cover mounted to the printer body so as to be opened and closed, wherein when the maintenance cover is opened, the pressure plate is exposed. With this construction, just after opening the maintenance cover, the pressure plate can be removed, thus smoothening the maintenance work.

The supporting mechanism may be rotatable to bring the printing head into contact with and separation from the platen. With this construction, the contacting and separating structure of the printing head with respect to the platen can be made simple. Accordingly, the structure of the printing head supporting device can be made simpler. Furthermore, the contacting and separating operation of the printing head with respect to the platen can be smoothened.

The printing head supporting device may further include means for biasing the printing head in such a direction as to move the printing head away from the platen. With this construction, when the pressure plate is removed, the printing head is automatically brought into separation from the platen by the biasing means, thus making the maintenance work easier.

The pressure plate may be provided with an elastic member for bringing the printing head into contact with the platen. With this construction, the printing head is elastically pressed against the platen by the elastic member. Accordingly, no high position accuracy between the pressure plate after mounted and the printing head is required, thereby making the designing and manufacturing easier.

The pressure plate may be adapted to be mounted and demounted with respect to the printer body in opposite directions perpendicular to contacting and separating directions of the printing head with respect to the platen, and the elastic member may be formed from a leaf spring having a spring portion extending away from the pressure plate toward a trailing end of the pressure plate with respect to the mounting direction thereof to the printer body. Further, the spring portion of the elastic member may be bent at a free end thereof toward the pressure plate. With this construction, the mounting and demounting operation of the pressure plate can be made easy.

The printing head supporting device may further include a screw for fixing the pressure plate to the printer body. With this construction, the pressure plate can be reliably positioned with respect to the printer body. Accordingly, a change in contact pressure between the platen and the printing head due to vibration or the like can be eliminated to thereby maintain a contact printing quality. In this case, a head portion of the screw may be formed with a groove having a width larger than a thickness of a coin. With this construction, the screw can be easily tightened and loosened by using the coin which is generally available. Accordingly, the pressure plate can be easily mounted and demounted without the need of any special tool in carrying out the maintenance work.

The printing head supporting device may further include a main frame configured to surround the printing head supported by the supporting mechanism, which main frame is formed at opposite side portions thereof with a pair of holding means and further formed at a rear portion thereof with a pair of abutment means spaced a given distance, wherein the pressure plate is configured such that opposite side portions of the pressure plate are adapted to engage the holding means of the main frame, and a rear end portion of the pressure plate is adapted to abut against the abutment means of the main frame. With this construction, when the rear end portion of the pressure plate is brought into abutment against the two abutment means, the pressure plate is reliably positioned with respect to the main frame. Accordingly, a change in contact pressure between the platen and the printing head due to vibration or the like can be eliminated to thereby improve a printing quality. In this case, the holding means of the main frame may be formed with a projection adapted to engage each of the opposite side portions of the pressure plate and thereby forcibly make the rear end portion of the pressure plate abut against the two abutment means of the main frame.

Other objects and features of the invention will be more fully understood from the following detailed description and appended claims when taken with the accompanying drawings.

DESCRIPTION OF PREFERRED EMBODIMENTS

Figure 1:
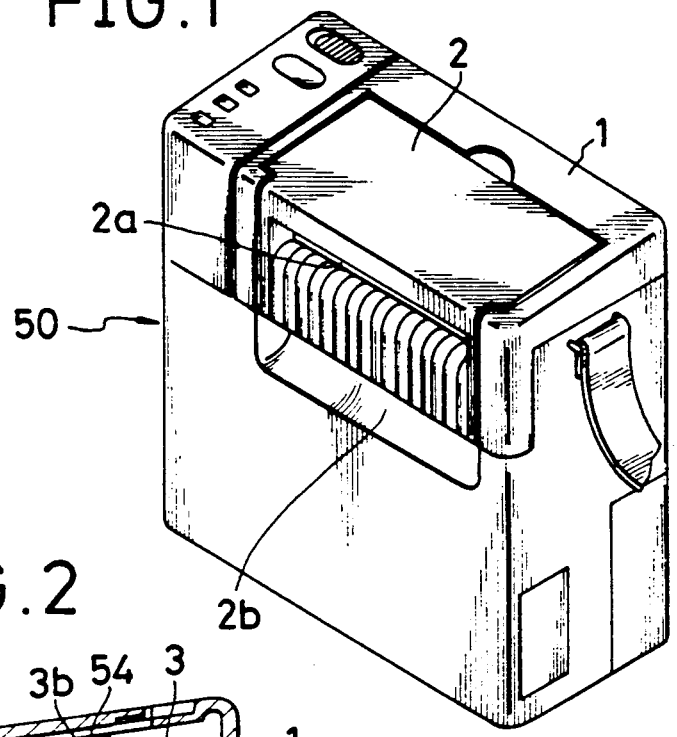
FIG. 1 is a perspective view of a bar code printer according to a first preferred embodiment of the present invention.

A first perferred embodiment of the present invention will now be described with reference to FIGS. 1 to 5. Referring to FIG. 1 which shows a general construction of a bar code printer 50 in perspective, the bar code printer 50 includes a body housing 1 and an L-shaped maintenance cover 2 provided on a front surface of the body housing 1 to an upper surface thereof. The maintenance cover 2 has a label issuing opening 2*a* a label base sheet ejecting opening 2*b*. A front portion of the maintenance cover 2 is rotatably connected to a lower end thereof to the body housing 1, so that the maintenance cover 2 can be opened and closed with respect to the body housing 1. FIG. 3 shows an open condition of the maintenance cover 2. As shown in FIG. 3, two pawls 2*c* are formed at an outer end of an upper surface of the maintenance cover 2 under the open condition. The two pawls 2*c* are adapted to be caught by two hook portions 2*d* of the body housing 1, thereby fixing the maintenance cover 2 to the body housing 1.

Figure 2:
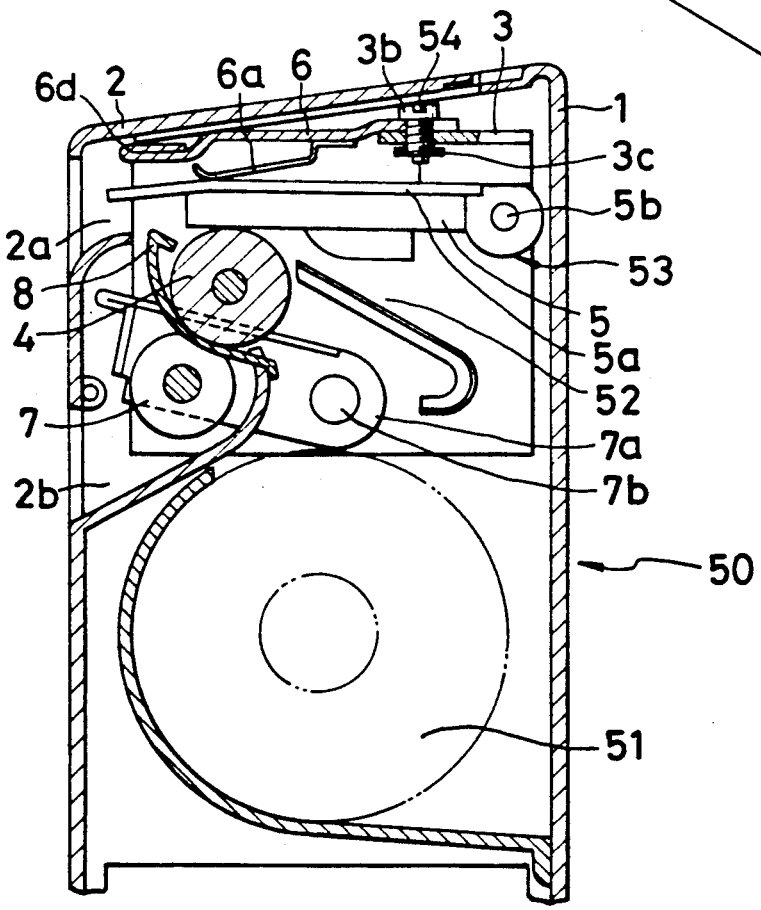
FIG. 2 is a vertical sectional view of the bar code printer shown in FIG. 1.
Figure 3:
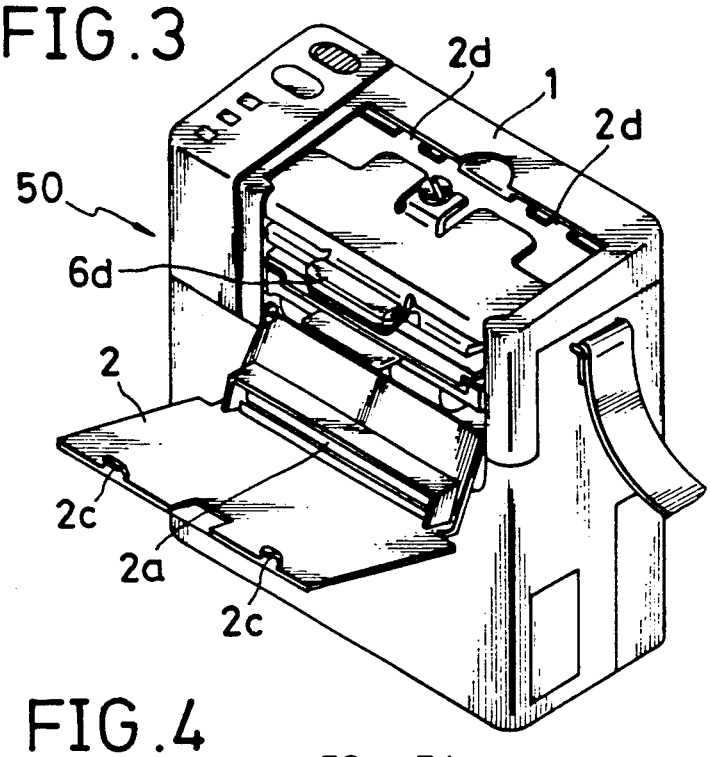
FIG. 3 is a perspective view of the bar code printer under the condition where a maintenance cover is open.

An internal structure of the bar code printer 50 is shown in FIG. 2. Referring to FIG. 2, a platen 4 is provided at a central portion in the bar code printer 50. A thermal head 5 as the printing head adapted to contact the platen 4 is provided above the platen 4. A pinch roller 7 adapted to contact the platen 4 is provided below the platen 4. A contact position between the thermal head 5 and the platen 4 is set in the vicinity of the label issuing opening 2*a*, and a contact position between the platen 4 and the pinch roller 7 is set in the vicinity of the label base sheet ejecting opening 2*b*. There is defined below the pinch roller 7 a space 51 for accommodating a roll of an elongated label base sheet (not shown) on which a plurality of labels (not shown) formed from a thermal paper are attached. Further, there is defined in the bar code printer 50 a guide path 52 for guiding the label base sheet drawn from the accommodating space 51 through the contact position between the thermal head 5 and the platen 4 and the contact position between the platen 4 and the pinch roller 7 to the label base sheet ejecting openings 2*b*. In the guide path 52 is provided a separating plate 8 for separating the labels after printed from the label base sheet and guiding the printed labels thus separated to the label issuing opening 2*a*.

The platen 4 is rotatably mounted to a main frame 3 of the bar code printer 50. The thermal head 5 is pivotably supported through a supporting mechanism 53 to the main frame 3. The supporting mechanism 53 is comprised of a head bracket 5*a* pivotably mounted through a pivotal shaft 5*b* to the main frame 3, and the thermal head 5 is mounted on the head bracket 5*a*. Further, a coil spring (not shown) as the biasing means is wound around the pivotal shaft 5*b*, and is engaged between the main frame 3 and the head bracket 5*a*, so that the head bracket 5*a* is biased by this spring to rotate in such a direction as to move away from the platen 4.

Figure 5:
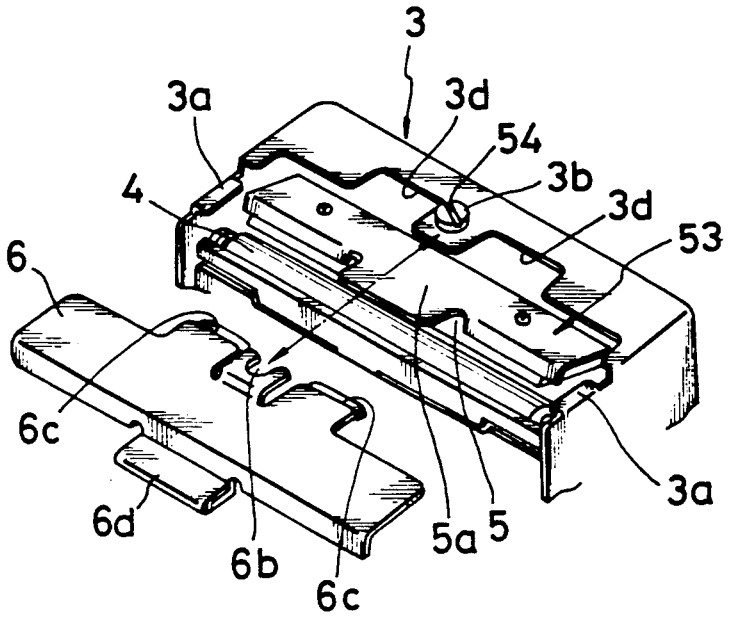
FIG. 5 is a perspective view showing a mounting structure of the pressure plate according to the first preferred embodiment.

A pressure plate 6 for pressing an upper surface of the head bracket 5*a* to maintain the thermal head 5 in pressure contact with the platen 4 is detachably mounted to the main frame 3. The pressure plate 6 is so configured as to be inserted from the front surface of the body housing 1 into a rear portion thereof. A head pressing member 6*a* as the elastic member is mounted on a lower surface of the pressure plate 6 opposed to the head bracket 5*a*. The head pressing member 6*a* is formed from a leaf spring, and it is configured such that a spring portion thereof is inclined downwardly toward a trailing end of the pressure plate 6 with respect to a mounting direction thereof to the main frame 3. The spring portion of the head pressing member 6*a* is rounded at its free end so as to be curved upwardly. As shown in FIG. 5, a leading end of the pressure plate 6 with respect to the mounting direction is formed with a central recess 6*b*, and is further formed with two stepped portions 6*c* adjacent to the recess 6*b* on the opposite sides thereof. Further, the trailing end of the pressure plate 6 with respect to the mounting direction to the main frame 3 is formed with a handle 6*d* adapted to be gripped for mounting and demounting the pressure plate 6. On the other hand, the main frame 3 is formed with a pair of guide portions 3*a* for guiding opposite side portions of the pressure plate 6. The guide portions 3*a* are formed by inwardly bending upper end portions of opposite side walls of the main frame 3. A fastening screw 3*b* threadedly engaged with the main frame 3 at a position where the recess 6*b* is brought into engagement with a threaded portion of the fastening screw 3*b* upon mounting the pressure plate 6. On the opposite sides of the fastening screw 3*b*, a pair of abutment portions 3*d* are formed at the rear upper portion of the main frame 3 in such that the stepped portions 6*c* of the pressure plate 6 are brought into abutment against the abutment portions 3*d* upon mounting the pressure plate 6. A head portion of the fastening screw 3*b* is formed with a groove 54 having a width larger than a thickness of a coin. Further, an E-ring 3*c* is mounted on the threaded portion of the fastening screw 3*b*, so as to prevent disengagement of the fastening screw 3*b* from the main frame 3.

A pinch roller bracket 7 is pivotably mounted through a pivotal shaft 7*b* to the main frame 3, and the pinch roller 7 is rotatably supported to the pinch roller bracket 7*a*. A coil spring (not shown) is wound around the pivotal shaft 7*b*, and is engaged between the main frame 3 and the pinch roller bracket 7*a*, so that the pinch roller bracket 7*a* is biased by the coil spring to rotate in such a direction as to maintain the pinch roller 7 in pressure contact with the platen 4.

In operation, when the platen 4 is rotated, the label base sheet stored in the accommodating space 51 is fed in the guide path 52, and predetermined printing is carried out on the labels attached on the label base sheet by the thermal head 5. The labels after printed are separated from the label base sheet by the separating plate 8, and are then issued from the label issuing opening 2*a*. On the other hand, the label base sheet from which the labels have been separated is ejected from the label base sheet ejecting opening 2*b*.

Figure 4:
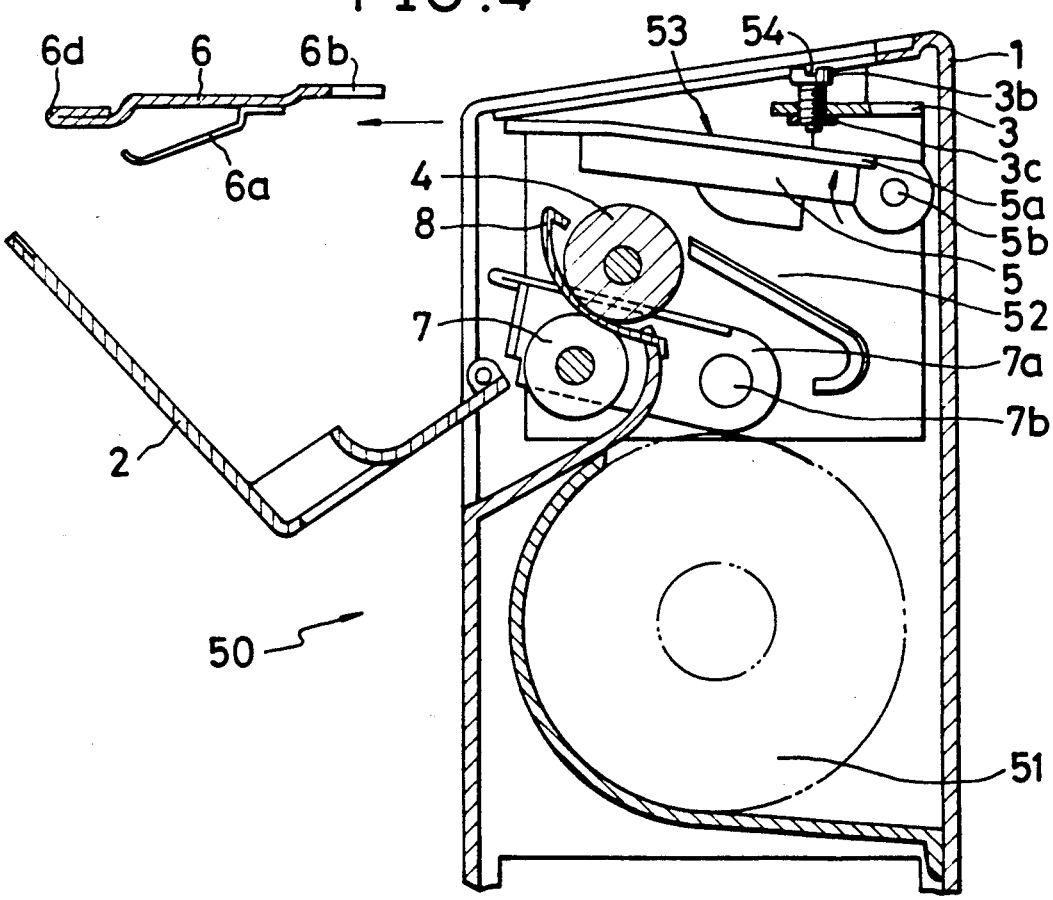
FIG. 4 is a vertical sectional view of the bar code printer under the condition where the maintenance cover is open, and a pressure plate is drawn off.

In the case of cleaning the thermal head 5 or removing the label base sheet caught between the thermal head 5 and the platen 4, the maintenance cover 2 is first opened (see FIG. 3), and the fastening screw 3*b* is then loosened by using a coin or the like. Therefore, the handle 6*d* is gripped to horizontally draw off the pressure plate 6 (see FIGS. 4 and 5). As a result, the head bracket 5*a* is rotated in the direction so as to move away from the platen 4 by a biasing force of the coil spring wound around the pivotal shaft 5*b*, so that the thermal head 5 comes into separation from the platen 4. This condition is shown in FIG. 4. Accordingly, by utilizing a spacing generated between the thermal head 5 and the platen 4 at this time, the cleaning of the thermal head 5 or the removal of the label base sheet caught between the thermal head 5 and the platen 4 is carried out. After ending the cleaning of the thermal head 5 or the removal of the label base sheet, the head bracket 5*a* is depressed from its upper side to rotate the thermal head 5 toward the platen 4, and the pressure plate 6 is horizontally inserted into the main frame 3. At this time, the opposite side portions of the pressure plate 6 are guided by the guide portions 3*a* of the main frame 3. When the stepped portions 6*c* of the pressure plate 6 comes into abutment against the abutment portions 3*d* of the main frame 3, the fastening screw 3*b* is tightened by using a coin or the like. Finally, the maintenance cover 2 is closed. During the insertion of the pressure plate 6 into the main frame 3, the head pressing member 6*a* mounted on the lower surface of the pressure plate 6 is gradually brought into contact with the head bracket 5*a*. On the other hand, during the removal of the pressure plate 6 from the main frame 3, the head pressing member 6*a* is not caught by the head bracket 5 since the free end of the head pressing member 6*a* is rounded as mentioned above. Thus, the pressure plate 6 can be smoothly mounted and demounted with respect to the main frame 3.

As described above, in carrying out a maintenance work such as the cleaning of the thermal head 5 or the removal of the label base sheet caught between the thermal head 5 and the platen 4, it is not necessary to carry out a complicated operation such as removal of the thermal head 5 from the main frame 3 or the like by using a special tool such as a screwdriver as in the prior art. Accordingly, the maintenance work can be made easy, and a working time required for the maintenance work can be widely reduced. Furthermore, since an opening operation of the maintenance cover 2 in mounting and demounting the pressure plate 6 is easily carried out in a single touch fashion, the maintenance work can be smoothened. Moreover, when the pressure plate 6 is removed, the thermal head 5 is automatically rotated in the direction so as to move away from the platen 4. Accordingly, the workability of the cleaning of the thermal head 5 or the like can be improved to thereby make the maintenance work easier.

Further, since the pressure contact of the thermal head 5 with the platen 4 is effected by the pressure plate 6 only, the pressing structure can be made simple, and it can be easily designed and manufactured. Moreover, since the pressure contact of the thermal head 5 with the platen 4 is substantially obtained by an elastic force of the head pressing member 6*a* as a leaf spring, no high position accuracy between the platen 4 and the thermal head 5 is required, thereby making the designing and manufacturing easier. Additionally, since the thermal head 5 is moved away from the platen 4 by the rotation of the head bracket 5*a* about the pivotal shaft 5*b*, the separation structure of the thermal head 5 from the platen 4 can be made simple.

Further, the pressure plate 6 is fixedly mounted to the main frame 3 by the fastening screw 3*b*. Accordingly, the pressure plate 6 is reliably positioned with respect to the main frame 3, and a contact pressure of the thermal head 5 to be applied to the platen 4 can be maintained uniformly. Accordingly, a constant printing quality can be maintained. Furthermore, the stepped portions 6*c* of the pressure plate 6 are formed at two positions spaced a given distance, and they are adapted to correspondingly abut against the abutment portions 3*d* of the main frame 3. Accordingly, the pressure plate 6 can be positioned easily and exactly. Also from this point of view, the printing quality can be made uniform. Additionally, the tightening and loosening operation of the fastening screw 3 upon mounting and demounting the pressure plate 6 can be easily effected by using a coin or the like for rotating the fastening screw 3. Accordingly, no special tool such as a screwdriver is required upon mounding and demounding the pressure plate 6, thus improving the workability.

In embodying the present invention, it is sufficient that the stepped portions 6*c* of the pressure plate 6 may have a shape capable of abutting against the abutment portions 3*d* of the main frame 3 and positoning the pressure plate 6. For example, the stepped portions 6*c* may be modified to have a tapering shape. Further, the structure of the printer to which the present invention is applied may be modified to carry out printing on a thermal paper or the like as the recording medium. Alternatively, the structure of the printer may be modified to carry out printing on a normal label rather than the thermal label, or on a plain paper with use of an ink ribbon or the like.

Figure 6:
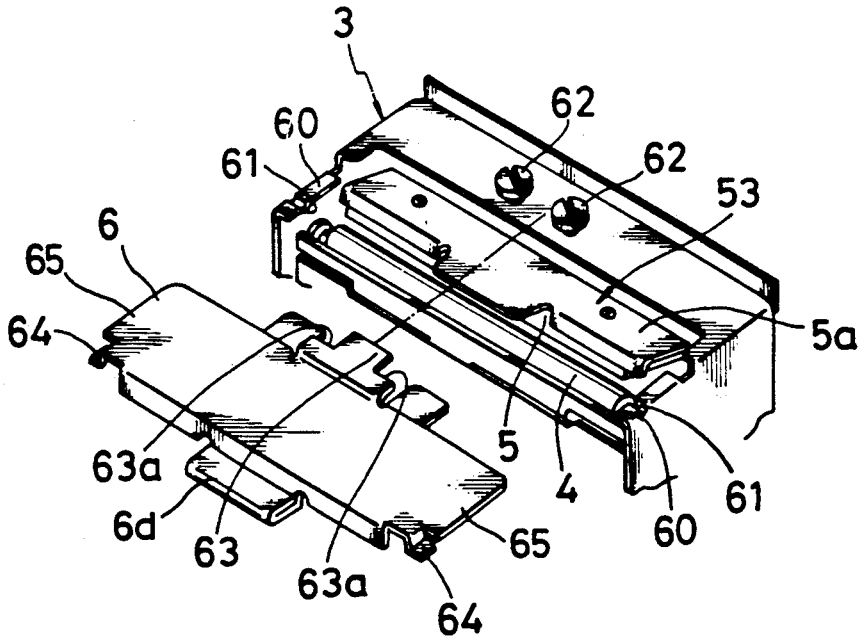
FIG. 6 is a view similar to FIG. 5, showing a second perferred embodiment of the present invention.

A second preferred embodiment of the present invention will not be described with reference to FIG. 6, in which the same parts as those in the first preferred embodiment are designated by the same reference numerals, and the explanation thereof will be omitted. Referring to FIG. 6, a pair of holding portions 60 are substituted for the guide portions 3*a* of the main frame 3 in the first preferred embodiment. The holding portions 60 have substantially the same shape as that of the guide portions 3*a*, and are formed at the same position as that of the guide portions 3*a*. However, each holding portion 60 is formed with a downward projection 61. The downward projection 61 may be formed by press working such as embossing or lancing. Further, the fastening screw 3*b* and the abutment portions 3*d* of the main frame 3 in the first preferred embodiment are replaced by a pair of guide pins 62 as the abutment means located at two positions spaced a given distance in the vicinity of the forming positions of the abutment portions 3*d*. On the other hand, the leading end of the pressure plate 6 is formed with a horizontal projection 63 adapted to be inserted between both the guide pins 62, and each side portion of the pressure plate 6 is formed with a pair of lower and upper sandwiching portions 64 and 65 so configured as to sandwich the corresponding holding portion 60. The horizontal projection 63 is formed with a pair of abutment positioning portions 63*a* adapted to abut against the guide pins 62 and thereby position the pressure plate 6. In mounting the pressure plate 6 to the main frame 3, when each lower sandwiching portion 64 gets over the downward projection 61 of each holding portion 60, the abutment positioning portions 63*a* are brought into abutment against the guide pins 62, thus forcibly positioning the pressure plate 6.

Under the mounted condition of the pressure plate 6, the sandwiching portions 64 and 65 operate to sandwich each holding portion 60 of the main frame 3, and the abutment positioning portions 63*a* of the horizontal projection 63 abut against the guide pins 62. Thus, the pressure plate 6 is reliably positioned with respect to the main frame 3. Accordingly, any rotating means such as a screwdriver or a coin for rotating the guide pins 62 si not required. That is, the pressure plate 6 can be manually mounted and demounted. As a result, the cleaning of the thermal head 5 or the removal of the label base sheet caught between the thermal head 5 and the platen 4 can be carried out very easily. Moreover, the pressure plate 6 is forced in an inserting direction thereof by the downward projectings 61 to make the abutment positioning portions 63*a* abut against the guide pins 62. Accordingly, rotation of the pressure plate 6 in clockwise and counterclockwise directions in a horizontal plane can be prevented to thereby position the pressure plate 6 always accurately. As a result, a depression force of the pressure plate 6 to be applied to the head bracket 5*a* is maintained uniformly, and the contact condition between the thermal head 5 and the platen 4 is therefore made uniform to thereby improve the printing quality.

Although the guide pins 62 are employed as the abutment means of the main frame 3 adapted to abut against the pressure plate 6 in the second preferred embodiment, the structure of the abutment means is not limited to the above. For example, the abutment means may be formed by lancing the main frame 3.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A printing head supporting device comprising:

a platen;

a printing head adapted to contact said platen through a recording medium interposed therebetween to carry out printing on said recording medium;

a supporting mechanism for supporting said printing head so that said printing head can be brought into contact with and separation from said platen; and a pressure plate detachably mounted to a printer body, wherein when said pressure plate is mounted to said printer body, said printing head is brought into contact with said platen by said pressure plate, while when said pressure plate is detached from said printer body, said printing head is allowed to separate from said platen by said pressure plate.

2. The printing head supporting device as defined in claim 1 further comprsing a maintenance cover mounted to said printer body so as to be opened and closed, wherein when said maintenance cover is opened, said pressure plate is exposed from said printer body.

3. The printing head supporting device as defined in claim 1, wherein said supporting mechanism is rotatable to being said printing head into contact with a separation from said platen.

4. The printing head supporting device as defined in claim 1 further comprising means for biasing said printing head in such a direction as to move said printing head away from said platen.

5. The printing head supporting device as defined in claim 1, wherein said pressure plate is provided with an elastic member for bringing said printing head into contact with said platen.

6. The printing head supporting device as defined in claim 5, wherein said pressure plate is adapted to be mounted and demounted with respect to said printer body in opposite directions perpendicular to contacting and separating directions of said printing head with respect to said platen, and said elastic member is formed from a leaf spring having a spring portion extending away from said pressure plate toward a trailing end of said pressure plate with respect to the mounting direction thereof to said printer body.

7. The printing head supporting device as defined in claim 5, wherein said pressure plate is adapted to be mounted and demounted with respect to said printer body in opposite directions perpendicular to contacting and separating directions of said printing head with respect to said platen, and said elastic member is formed from a leaf spring having a spring portion extending away from said pressure plate toward a trailing end of said pressure plate with respect to the mounting direction thereof to said printer body, said spring portion of said elastic member being bent at a free end thereof toward said pressure plate.

8. The printing head supporting device as defined in claim 1 further comprising a screw for fixing said pressure plate to said printer body.

9. The printing head supporting device as defined in claim 8, wherein a head portion of said screw is formed with a groove having a width larger than a thickness of a coin.

10. The printing head supporting device as defined in claim 1 further comprising a main frame configured to surround said printing head supported by said supporting meachanism, said main frame being formed at opposite side portions thereof with a pair of holding means and further formed at a rear portion thereof with a pair of abutment means spaced a given distance, wherein said pressure plate is configured such that opposite side portions of said pressure plate are adapted to engage said holding means of said main frame, and a rear end portion of said pressure plate is adapted to abut against said abutment means of said main frame.

11. The printing head supporting device as defined in claim 10, wherein said holding means of said main frame is formed with a projection adapted to engage each of said opposite side portions of said pressure plate and thereby forcibly make said rear end portion of said pressure plate abut against said abutment means of said main frame.

* * * * *